US006076261A

United States Patent [19]

Eriksson et al.

[11] Patent Number: 6,076,261

[45] Date of Patent: Jun. 20, 2000

[54] SHEATH FOR HANDSAWS

[75] Inventors: Eckhard Eriksson, Obernau, Switzerland; Staffan Lindberg; Staffan Garras, both of Edsbyn, Sweden

[73] Assignee: Sandvik AB, Sandviken, Sweden

[21] Appl. No.: 09/173,718

[22] Filed: Oct. 16, 1998

[30] Foreign Application Priority Data

Oct. 17, 1997 [SE] Sweden ..... 9703789

[51] Int. Cl.[7] ..... A45C 11/00

[52] U.S. Cl. ..... 30/151; 30/514; 206/349

[58] Field of Search ..... 30/144, 151, 166.3, 30/514; 206/349; 7/148; 224/197

[56] References Cited

U.S. PATENT DOCUMENTS

| | | | |
|---|---|---|---|
| 144,177 | 10/1873 | Williams | 30/151 |
| 2,524,110 | 10/1950 | Kuemmerling | 30/514 |
| 2,859,516 | 11/1958 | McQueary | 30/151 |
| 2,867,363 | 1/1959 | Kuemmerling | 206/349 |
| 3,837,024 | 9/1974 | Saunders | 30/151 |
| 4,389,775 | 6/1983 | Collins | 30/151 |
| 5,706,941 | 1/1998 | Erisoty | 206/349 |

FOREIGN PATENT DOCUMENTS

| | | |
|---|---|---|
| 7-328959 | 12/1995 | Japan . |
| 113470 | 3/1945 | Sweden . |

*Primary Examiner*—Hwei-Siu Payer
*Attorney, Agent, or Firm*—Burns, Doane, Swecker & Mathis, L.L.P.

[57] ABSTRACT

A sheath for handsaws of the kind having an elongated toothed blade and a handle at one end includes an elongated body with an open groove along the majority of the length of the body to receive the tooth line of the saw. Near a free lower end, the body carries a cover which releasably holds the free end of the saw blade. At the opposite upper end there is a clamp which releasably holds the handle portion of the saw. This makes it possible to release the saw from the sheath by small, comfortable swinging motions.

10 Claims, 4 Drawing Sheets

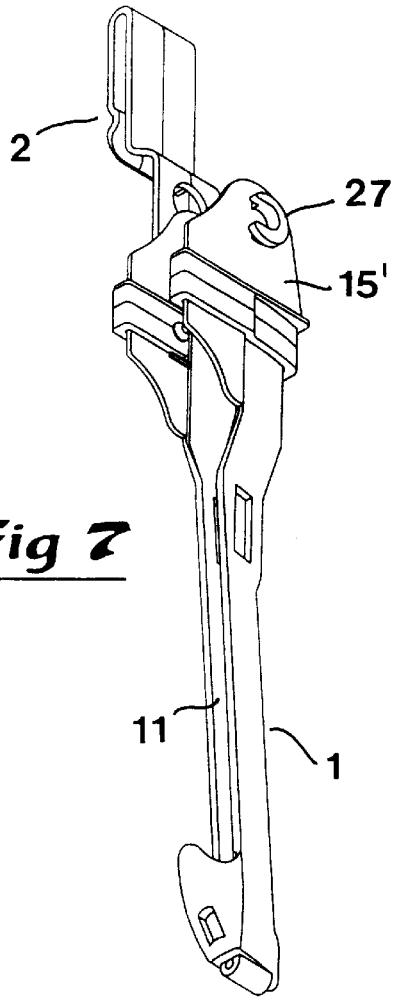
Fig 7
Fig 8
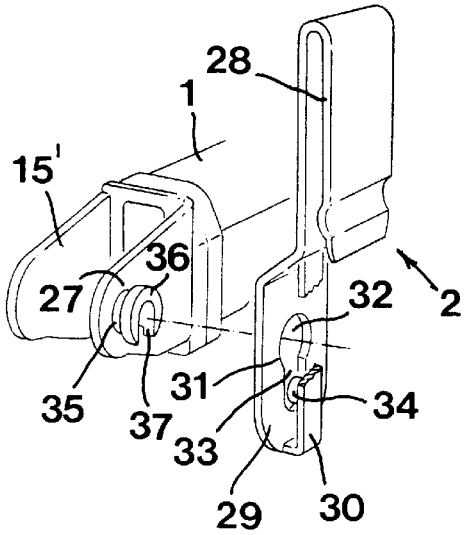
Fig 11
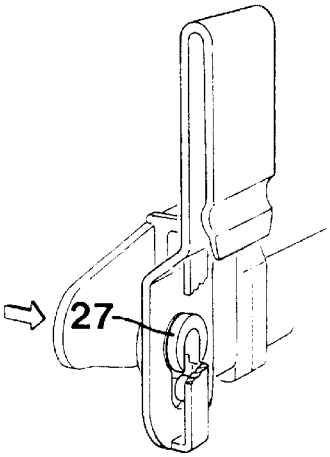
Fig 9
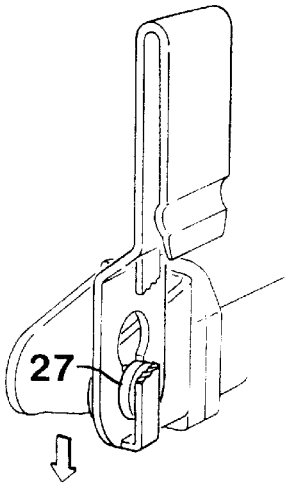
Fig 10
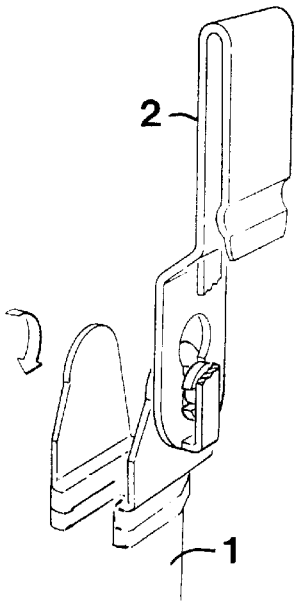

SHEATH FOR HANDSAWS

FIELD OF APPLICATION OF THE INVENTION

This invention concerns a sheath for handsaws of the kind comprising an elongated toothed blade and a handle at one end of this, the sheath comprising an elongated stiff body delimiting a cavity into which the saw blade can be inserted to keep its teeth from contact with the environment, and a device for attaching the sheath directly or indirectly to a carrier part of the dress of an operator, such as a belt.

BACKGROUND OF THE INVENTION

Handsaws of the type among craftsmen called pruning saws are used not only for nonprofessional gardening but also professionally such as for pruning of growing plants in vineyards, large fruit orchards or similar.

The accessability of the saw is of great importance for the practical work situation of the operator, especially the possibility to carry and hold the saw with other means than the hands, and still be able to grip it when needed for the job. One difficulty for the operator is that he may have to use many more tools during the work, such as shears, loppers, knives or means for bark wound healing. When climbing a ladder, it may be vital to have both hands free, and not occupied by holding and carrying a saw which is not used right then. Shortly afterward, the saw must be brought out and held in the hand for a sawing task. This must also be done with little effort and limited motion, since the operator might have a complicated body stance among tree branches, where the space available for saw and arm displacements is limited.

One sheath of the kind mentioned is known from JP 7328959. That sheath is based on a conventional sheath with a top opening where the saw blade must be inserted, followed by moving it axially for its full length until it reaches the sheath bottom. Reversely, the saw must be fully pulled out axially from the sheath when it is to be removed. That type of sheath is thus badly suited for the use situation described above.

PURPOSE OF THE INVENTION

The present invention aims at overcoming the disadvantages of the cited sheath, and to create one better suited. One purpose of the invention is to create a sheath which is simply and comfortably carried by the operator and which will allow fast and simple releasing of the saw when it is needed, as well as simple reinsertion of it after use. Another purpose is o create a sheath which can be securely attached to part of the operators dress, such as a belt, and easily be disattached from it when desired. The invention further aims at creating a sheath which will not collect dirt and moisture, and at the same time be visually pleasing and durable. It is also an aim of the invention to create a sheath which allows insertion of the saw and its blade without the teeth interfering with the clothing.

According to the invention, at least the main purpose is fulfilled by the features disclosed in the characteristics of claim 1. Preferred embodiments are furthe described in the subsidiary claims.

FURTHER DESCRIPTION OF STATE OF THE ART

It is earlier known from SE 113 470 to use a tooth protector formed as a partly open profile. This profile can not in practice be used as a sheath. One reason for this is that the pocket which is to receive the tip of the saw blade is relatively long and requires that the tip is inserted axially in the pocket, no angular mobility is possible. A further reason is that the tooth protector is to be connected to the handle of the saw by a leather strap, which in practise must be tied in place with a knot. It would defeat the purpose of the invention to have a strap which has to be tied or untied whenever the saw is to be put away or taken out of the profile. Also, SE 113 470 does not include any means for attachment to the operators garment.

DETAIL DESCRIPTION OF SOME PREFERRED EMBODIMENTS OF THE INVENTION

Figure 1:
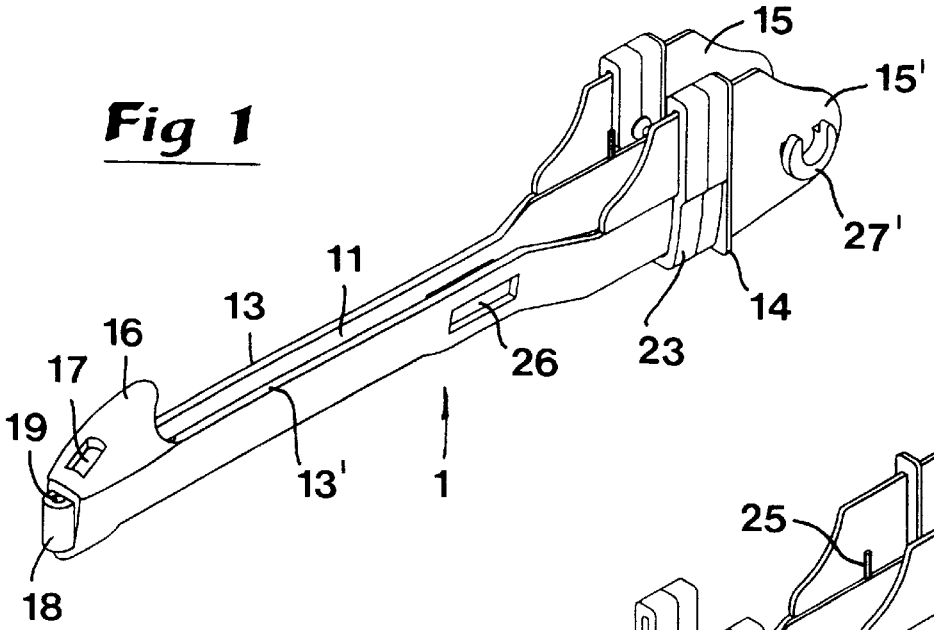
FIG. 1 a perspective view of a saw sheath according to the invention
Figure 3:
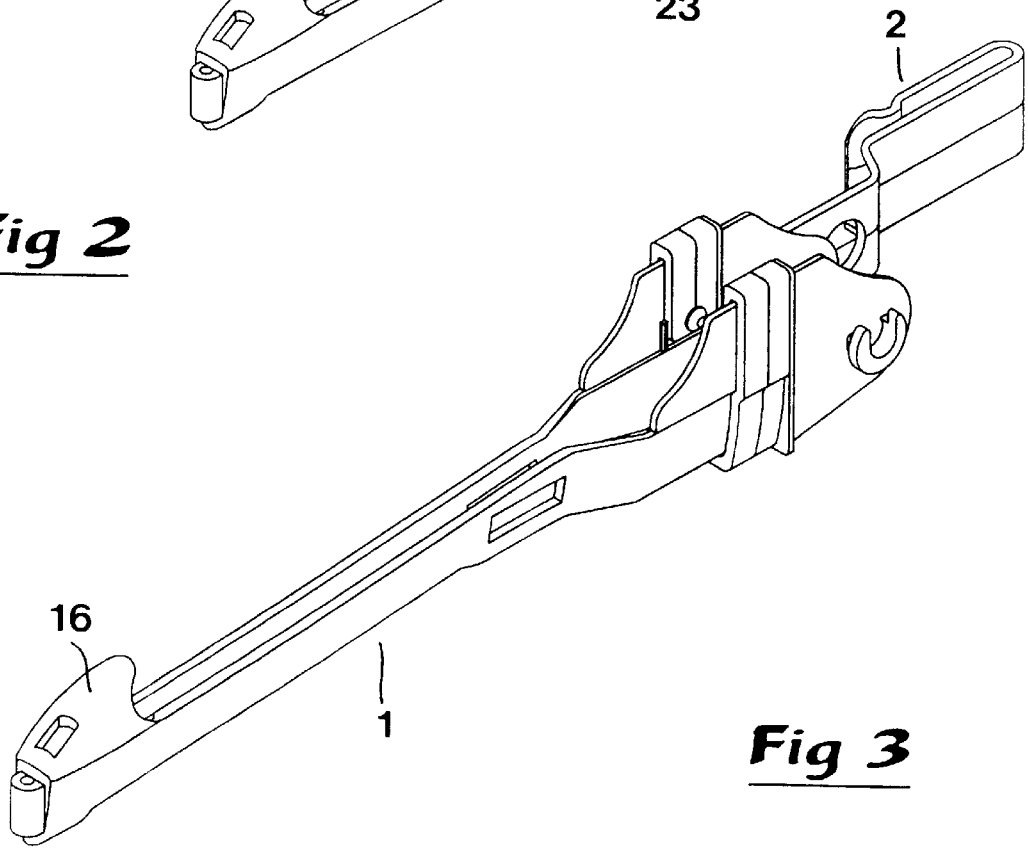
Figure 5:
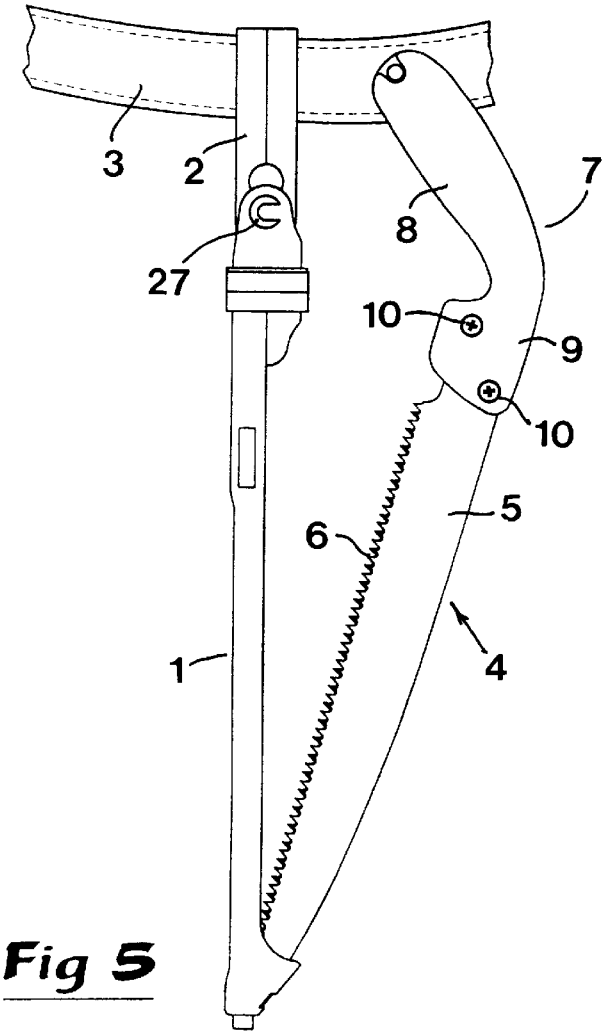
Figure 4:
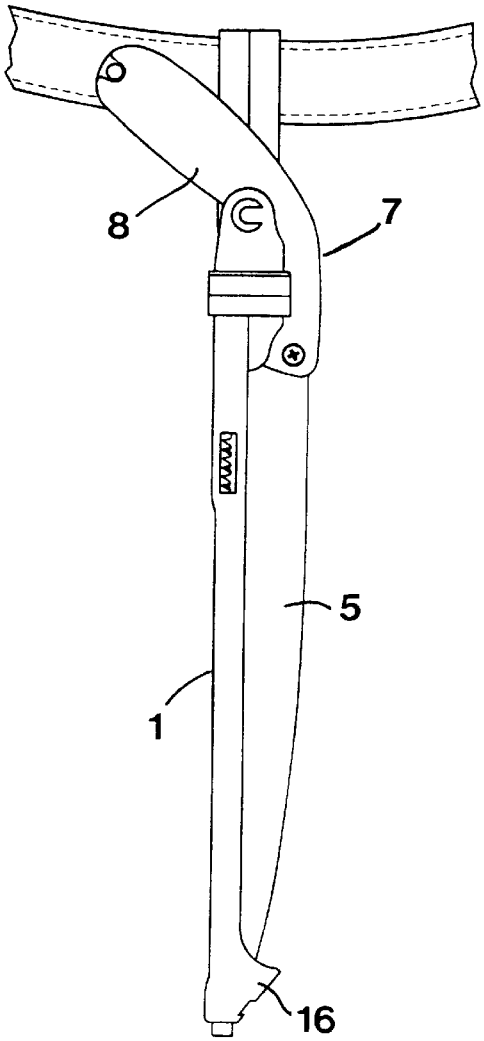

In FIG. 1 the sheath body is marked 1. As shown in FIG. 3 this sheath can preferably be combined with a separate hanger 2 which can be releasably attached to a belt 3 as shown in FIGS. 4 and 5. The two latter figures also show that the sheath is made to receive a handsaw designated as 4 and comprising an elongated saw blade 5 with teeth 6 and a handle 7, the latter having a gripping part 8 and a fastening part 9 into which the saw blade is inserted. More specifically, the blade is secured to the fastening part 9 of the handle with two screw members 10. It should also be mentioned that the gripping part 8 of the handle has a basic shape of a pistol handle, forming a relatively large but acute angle, 40–55 degrees, with a straight line extension of the saw blade tooth line.

Figure 6:
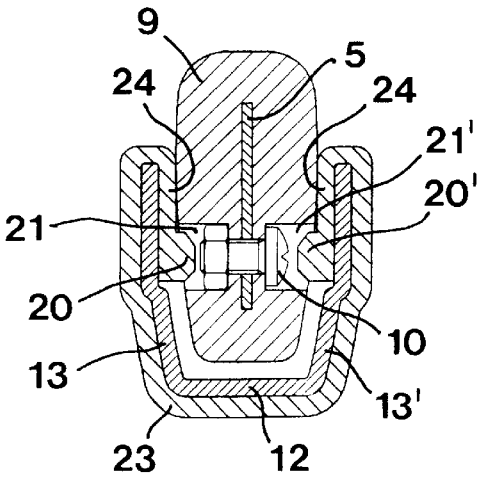

Referring again to FIGS. 1–3, these show how the sheath is made as an elongated stiff body with an open groove 11 along the main part of the body length. This groove is delimited by a bottom 12 and two side walls 13,13', compare FIG. 6. Along the distal or lower portion of the groove, these side walls extend close to each other, at the rear or upper portion they diverge to make room for the handle 7 of the saw. In this upper portion the side walls have greater height than in the lower portion. The side walls and the bottom end together at the transversal wall 14, from which two flanges 15,15' extend parallel to each other without any bottom continuation.

At the distal or lower end of the sheath body is located a short, upward open cover 16, preferrably made continuous with the low side walls 13,13'. The purpose of the cover 16 is to receive the free end or tip of the saw blade 5, and will thus serve as a releasable holder of the free end of the saw blade. The cover 16 is preferrably made with a through hole 17 through which dirt and moisture can be automatically emptied from the interior of the cover. At the extreme lower end of the sheath body there is a tubular part 18 with a transversal cavity 19 through which a string or a strap can be attached if desired for the purpose of enabling the lower part of the sheath to be tied to the leg of the operator.

Figure 2:
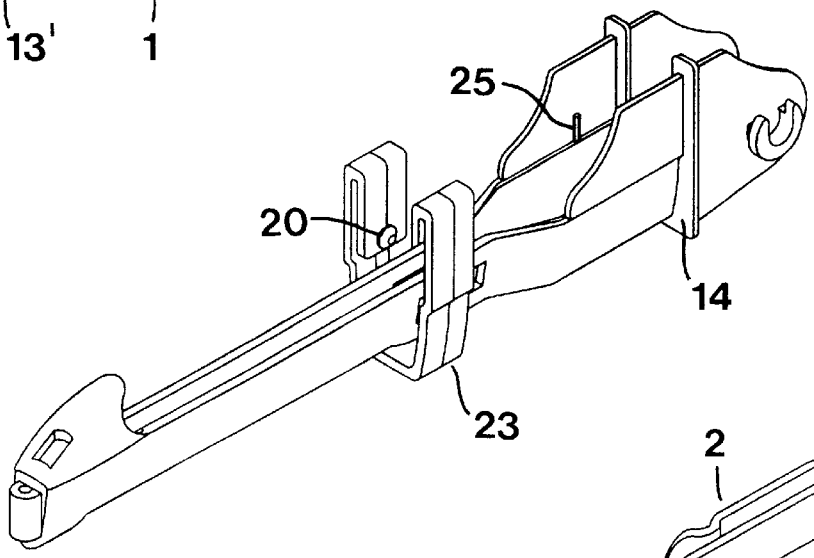
FIG. 2 a corresponding perspective view of a U-clamp partly detached from the sheath body FIG. 3 a perspective view including also a hanger by means of which the sheath can be attached to a belt FIG. 4 a lateral view of a sheath attached to a belt with the saw in stored position FIG. 5 a corresponding view with the saw partly released from the sheath FIG. 6 an enlarged cross-section through the sheath and the saw handle in the region of the U-clamp FIG. 7 a perspective view of the sheath and the hanger in a state ready for suspending on a belt FIGS. 8–11 perspective views of a preferred means for swingable connection of the sheath body to the hanger shown in FIGS. 3–5

A second element for releasable holding of the saw is a spring catch to elastically hold the saw handle to the sheath body. The spring catch consists of two protrusions 20,20', see FIG. 6, which protrude inwards from the side walls of the sheath body, and which can snap into two recesses 21,21' in the saw handle. These recesses are formed by letting one screw 10 for connecting the blade 5 to the fastening part 9 of the handle be distinctly shorter than the transversal hole where the screw is located. This creates enough space between the ends of the screw and the mouths of the hole to allow both protrusions 20,20' to be pressed in. Pressing in of the protrusions can be accomplished by the innate elasticity of the side walls 13,13' of the sheath body. However, for reasons of manufacturing ease, it is suitable to make the sheath body proper from a polymer material with limited elasticity. The two protrusions 20,20' are then preferrably located on a separate elastic part, basically shaped as a U-clamp 23, specifically on inwardly folded extensions 24 on the clamp. The U-clamp should be made from a polymer material with large elastic deformability and with a definite shape memory to allow it to return to the same shape even after large deformation. One suitable material is polyoxymethylene. To facilitate their entrance into the recesses 21,21' the protrusions 20,20' can preferrably be made tapering. As shown in FIG. 2 the U-clamp 23 can be separately made but permanently attached to the sheath body by sliding it axially along the sheath body from a starting position to a contacting position with the transversal wall 14, whereby it slides past locking means 25 on the inside of the high portions of the side walls 13,13'. Said locking means 25 ensure that the U-clamp is locked in the desired position when it has contacted the transversal wall 14.

In the low side walls at the lower portion of the body there can be made openings 26 through which the teeth of an inserted saw can be viewed from the exterior.

On the outside of each flange 15,15' is located a connecting means 27,27' for connection of the sheath body to a hanger 2, which in turn can be applied to a belt 3 as shown in FIGS. 4 and 5. This hanger is made as a spring clip with an upper U-shaped hook 28 which can be fastened to the belt to be securely held.

In one preferred embodiment of the invention the connecting means 27,27' is part of a joint device further shown in FIGS. 8–11, enabling the sheath body to swing freely relative to the hanger when in use, and to be removed if desired.

The lower part of the hanger 2 comprises a first flat element 29 connected at the lower end to a second flat element 30, narrower than the first element. In the first element 29 is made a keyhole shaped through hole 31. This hole has a first wider portion 32, preferrably round, and a second elongated narrower portion 33. In practise, the round portion 32 may have a diameter which is 1.5 to 2 times the width of the elongated hole portion 33. On the inside of the second flat element 30 is located a protrusion 34 facing the lower part of the elongated narrower hole portion 33. In practise the protrusion 34 can be made as a cylindrical shaft made continuous with the element 30.

The connecting means 27 is generally horseshoe-shaped and comprises an inner neck 35 extending straight from the flange 15,15', having at its outer end a collar or thickening 36. The neck 35 and the collar 36 have a common side opening 37, in the described application at right angle to the axial direction of the sheath. The outer diameter of the collar 36 is slightly less than the inner diameter of the round hole portion 32, but clearly larger than the width of the narrow elongated hole portion 33. The diameter of the neck 35 is slightly less than the width of the narrow hole portion 33.

The use of the connecting means is clear from FIGS. 8–11. When the sheath is to be connected to the hanger, they are oriented at right angles, and the connecting means 27 is inserted through the wide round portion 32 of the hole 31 as is indicated with the arrow in FIG. 9. In the next step shown in FIG. 10, the connecting means is moved down into the narrow portion 33 of the hole, where it will enclose the protrusion 34 on the inside of the disc-shaped element 30. In a last step according to FIG. 1 the sheath is rotated 90 degrees to a freely hanging position. In this state, the sheath can swing relative to the hanger, but is at the same time secured to it since the protrusion 34 is enclosed by the connecting means and will thus prevent vertical displacements between the sheath and the hanger.

To disconnect the sheath from the hanger, the sheath must first be rotated again to an orientation 90 degrees to the hanger. The connecting means is then moved up to the wide portion 32 of the hole and moved to the side out from the hole. As shown in FIGS. 7 and 8, the opening 37 is open in the same direction as the open groove 11 of the sheath 1. The sheath is worn vertically from the waist of the operator with the opening forward. Having both the connecting means and the groove open forward reduces the risk of unintentional release of the sheath from the hanger. The sheath can only be released in one specific position, rotated 90 degrees backwards from the vertical position of FIG. 7. The probability of accidentally bringing the sheath into this position during practical work is negligible. Only by intentional rotation of the sheath to a horizontal rearward position can the operator release or connect the sheath.

Figure 12:
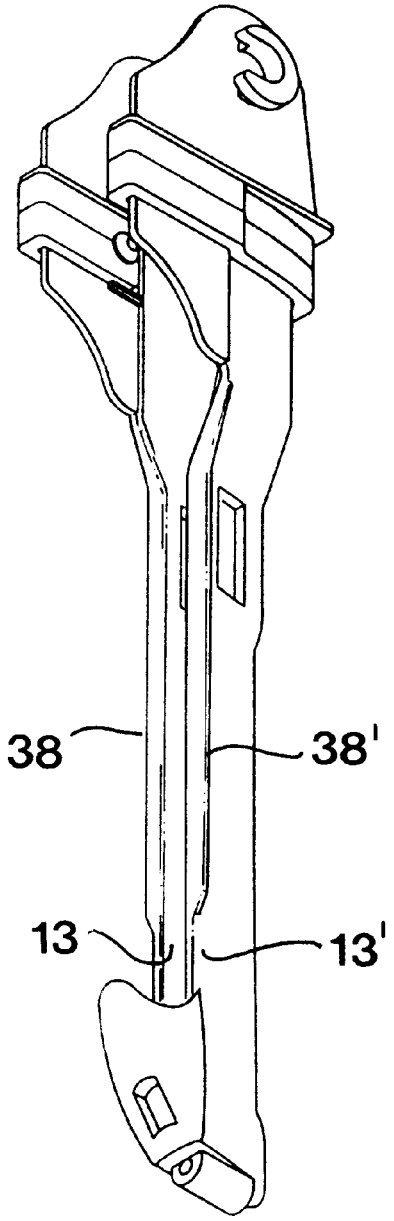
FIG. 12 a perspective view of an alternative preferred shape of the sheath body FIG. 13 an enlarged cross-section through the sheath body according to FIG. 12
Figure 13:
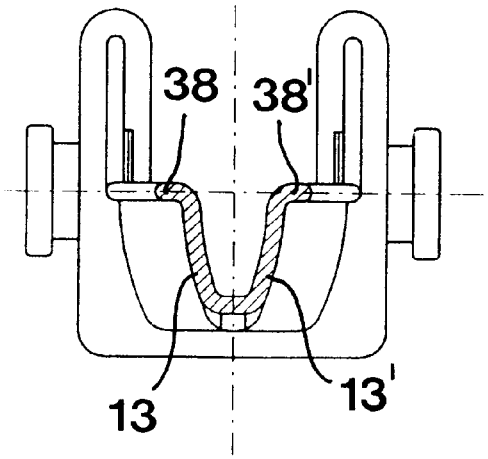

Referring to FIGS. 12 and 13, they illustrate one alternative preferred embodiment of the invention. It differs from the sheath shown in the other figures in having the side walls of the sheath body provided with laterally protruding flanges 38,38'. Their purpose is to keep the groove and the saw blade further away from the legs of the operator, and from his dress. Referring to FIG. 13, the groove cross section may be wider near the opening, which makes it easier to insert the saw blade.

FUNCTION AND ADVANTAGE OF THE INVENTION

FIG. 4 shows the sheath containing a saw, with the free end of the saw inserted in the cover 16 and the protrusions 20,20' entered into the recesses 21,21' on the outside of the handle. In this state, the gripping part 8 of the handle extends between the upper flanges 15,15' of the sheath, pointing obliquely upward-rearward. The gripping part is then easily accessible for the hand.

When the saw is to be released from the sheath, the handle is gripped and pushed out from the upper portion of the sheath, and a limited force is enough to make the elastic wall parts bend apart to remove the protrusions 20,20' from the recesses. The saw can then as shown in FIG. 5 be swung out, and the saw tip can then be removed from the cover 16 with a short pulling motion.

When reinserting the saw into the sheath, the opposite procedure is used., the saw tip is first inserted into the cover 16 and the handle is then pressed in between the side walls of the upper portion of the sheath, thereby moving the protrusions 20,20' back into the recesses of the handle.

One fundamental advantage is that the saw can be released from a sheath according to the invention by a simple motion, a rotation in a tangent plane without any axial displacement, such as would have been needed if the saw had been inserted in a tubular sheath. For the operator, this means that the saw can be released with small comfortable movements which do not require much space for the arms. Another advantage is that the sheath can be allowed to swing freely relative to the hanger applied to the belt without being permanently connected. With the joint described in FIGS. 8–11 the sheath can be easily disconnected from the hanger whenever desired. There is one connecting means 27,27' on each of the flanges 15,15'. This allows a choice of hanging the sheath on the left or right side of the waist.

POSSIBLE MODIFICATIONS OF THE INVENTION

The invention is not restricted to the embodiments shown in the figures. It will be possible to exchange the cover for the saw tip or the elastic protrusions to hold the handle recesses for other known elements for releasable holding of the saw tip and the handle. One or more magnets might be used for this purpose. Likewise, it is not necessary to attach the sheath to a hanger at the belt. It would also be possible to attach the sheath to the dress with adhesive or burr strip. That would also allow attaching the sheath to the lower leg of the operator if desired.

We claim:

1. A sheath for a handsaw of the kind having an elongated blade and a handle at one end, the sheath comprising an elongated stiff body delimiting a cavity into which the saw blade can be inserted to protect its teeth, and provided with at least one means for connecting directly or indirectly to a part of an operator's clothing or belt, said cavity being a groove open to one direction along the major part of the length of the body, delimited by one bottom and two side walls, the side walls being parallel and close together in a lower portion of the sheath which houses the saw blade and the side walls diverging in an upper portion of the sheath which accommodates the handle, said body near a lower end of said lower portion being provided with a first means for releasable holding of the free end of the saw blade and near the upper portion opposite the lower portion being provided with a second means for releasable holding of the handle of the saw, whereby the saw is released from the sheath body by lateral motion relative to it.

2. The sheath according to claim 1, wherein said first means is a short upwardly open cover into which the free end of the saw blade can be inserted.

3. The sheath according to claim 1, wherein said second means is a spring catch which can elastically snap into parts of the handle.

4. The sheath according to claim 1, wherein the side walls have a greater height at the upper portion than at the lower portion.

5. The sheath according to claim 3, wherein the side walls in the upper portion are elastically deformable, and wherein said spring catch comprises two protrusions extending from inside portions of the side walls, the protrusions arranged to snap into recesses in the saw handle.

6. The sheath according to claim 5, wherein the protrusions are located on inwardly folded extensions of a U-shaped clamp of a material with greater elasticity than a material of the body.

7. The sheath according to claim 1, wherein the side walls of the body have at their free edges laterally outward extending flanges serving to keep the groove and thereby the saw blade away from the leg of a user, and from his clothing.

8. The sheath according to claim 1, wherein the sheath body is disconnectably connected to a separate hanger attachable to a belt or other garment part, by said connecting means which allows swinging motion of the sheath body relative to the hanger, and allows disconnection of the sheath body from the hanger.

9. The sheath according to claim 1, in combination with a hanger, the hanger comprising two elements, the first element being provided with a generally keyhole-shaped through hole with one wide portion and one narrower portion, and the second element carrying a protrusion located opposite to and facing the narrower portion, and said connecting means having an inner neck and a collar, the neck and the collar having a common side opening, said connecting means being insertable with the collar through the wide portion of the hole with the side opening turned towards said protrusion and thereafter being axially movable into the narrower portion to let the connecting means enclose the protrusion, whereafter the sheath body is secured to the hanger by rotation relative to the hanger.

10. The sheath according to claim 9, further comprising a second connecting means, wherein are each of the connecting means are located on opposite sides of the sheath body to enable hanging of the sheath on either side of a user's waist.

* * * * *